US010631095B2

(12) United States Patent
Moriyama et al.

(10) Patent No.: US 10,631,095 B2
(45) Date of Patent: Apr. 21, 2020

(54) SPEAKER DEVICE, AND METHOD FOR IMPROVING SOUND QUALITY OF SPEAKER DEVICE

(71) Applicant: MORIYAMA MEIBOKU CO., LTD., Fukuoka (JP)

(72) Inventors: Tatsuyoshi Moriyama, Fukuoka (JP); Kazuaki Machida, Fukuoka (JP)

(73) Assignee: MORIYAMA MEIBOKU CO., LTD., Fukuoka (JP)

( * ) Notice: Subject to any disclaimer, the term of this patent is extended or adjusted under 35 U.S.C. 154(b) by 0 days.

(21) Appl. No.: 15/563,486

(22) PCT Filed: Apr. 19, 2016

(86) PCT No.: PCT/JP2016/062328
§ 371 (c)(1),
(2) Date: Sep. 29, 2017

(87) PCT Pub. No.: WO2017/183098
PCT Pub. Date: Oct. 26, 2017

(65) Prior Publication Data

US 2018/0343523 A1 Nov. 29, 2018

(51) Int. Cl.
*H04R 9/06* (2006.01)
*H04R 9/02* (2006.01)
(Continued)

(52) U.S. Cl.
CPC ..... *H04R 9/06* (2013.01); *H04R 1/22* (2013.01); *H04R 3/002* (2013.01); *H04R 9/02* (2013.01);
(Continued)

(58) Field of Classification Search
CPC . H04R 1/20; H04R 1/22; H04R 3/002; H04R 7/18; H04R 7/127; H04R 9/06; H04R 9/025; H04R 2400/11
(Continued)

(56) References Cited

U.S. PATENT DOCUMENTS 4,243,839 A * 1/1981 Takahashi ..... H04R 3/002 381/96
5,815,587 A * 9/1998 Goller ..... H04R 9/04 381/400
7,940,950 B2 * 5/2011 Shim ..... H04R 9/02 381/189

FOREIGN PATENT DOCUMENTS

JP 1978-084345 7/1978
JP 1978-142217 12/1978
(Continued)

*Primary Examiner* — Jesse A Elbin
(74) *Attorney, Agent, or Firm* — Heedong Chae; Lucem, PC

(57) ABSTRACT

A speaker device 101 includes vibrating body components constituting a vibrating body, consisting of at least a voice coil 119, a diaphragm 106, and a frame 102, and magnetic circuit components constituting a magnetic circuit, consisting of at least a plate 103, a yoke 104, a magnet 105, and a center pole 112. By winding an insulation coated conductor wire 120 around an outer circumference of any of the magnetic circuit components and connecting one end and the other end of the insulation coated conductor wire, a current flows in the insulation coated conductor wire 120 and makes (+) potentials and (−) potentials that are mixed on the surface of the magnetic circuit component and cause an eddy current equal to each other instantaneously, so that generation of an eddy current can be suppressed.

6 Claims, 8 Drawing Sheets

(51) Int. Cl.

| | |
|---|---|
| ***H04R 1/22*** | (2006.01) |
| ***H04R 3/00*** | (2006.01) |
| ***H04R 7/12*** | (2006.01) |
| ***H04R 7/18*** | (2006.01) |

(52) U.S. Cl.
CPC ..... *H04R 9/025* (2013.01); *H04R 7/127* (2013.01); *H04R 7/18* (2013.01); *H04R 2209/021* (2013.01); *H04R 2400/11* (2013.01)

(58) Field of Classification Search
USPC ..... 381/409, 410, 412, 413, 414
See application file for complete search history.

(56) References Cited

FOREIGN PATENT DOCUMENTS

| | | | |
|---|---|---|---|
| JP | 1980-082897 | | 6/1980 |
| JP | 05-083794 | A | 4/1993 |
| JP | 1997-051597 | A | 2/1997 |
| JP | 1999-122694 | A | 4/1999 |
| JP | 2006-060333 | A | 3/2006 |

* cited by examiner

[Fig. 1]
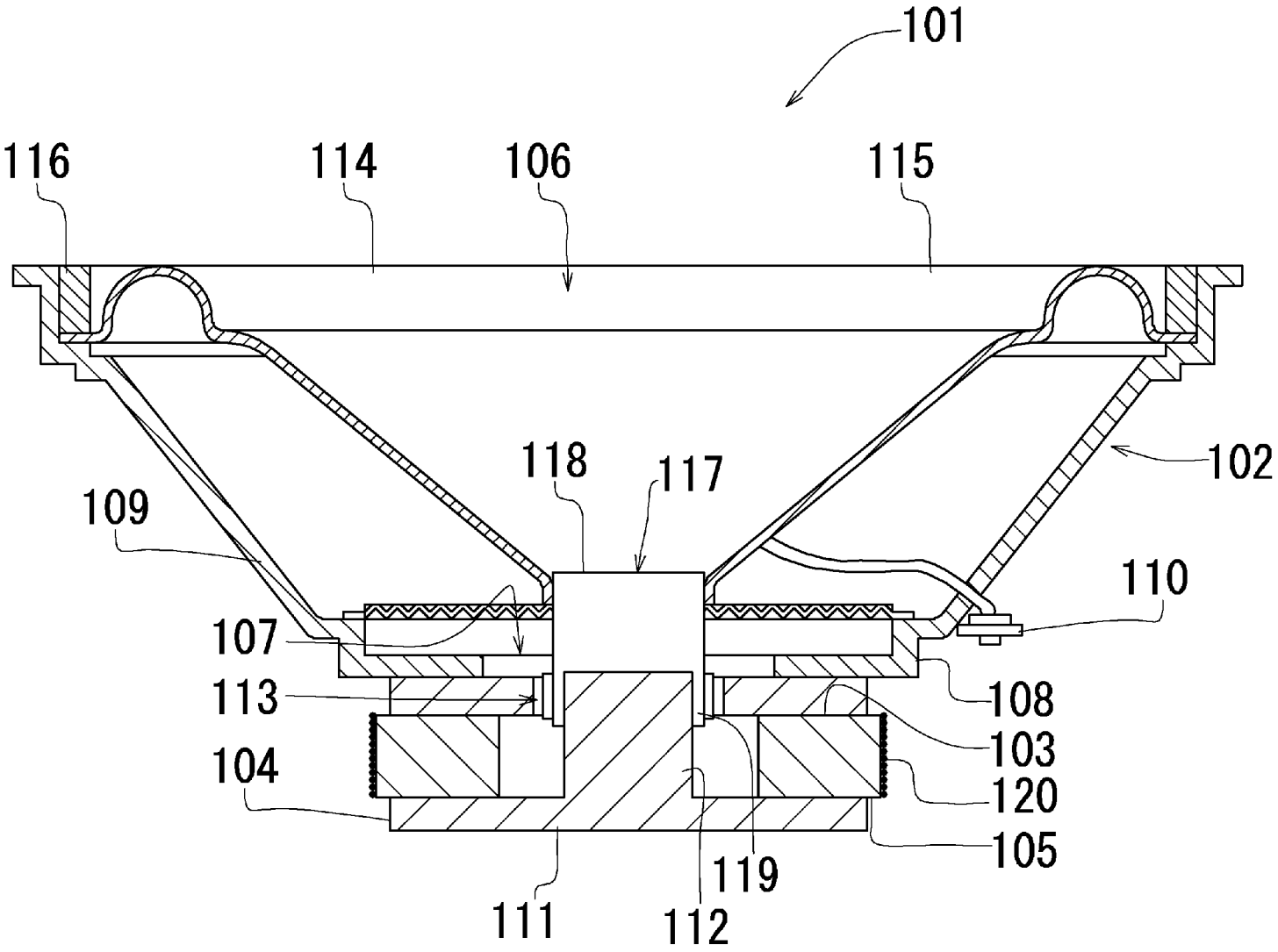

[Fig. 2]
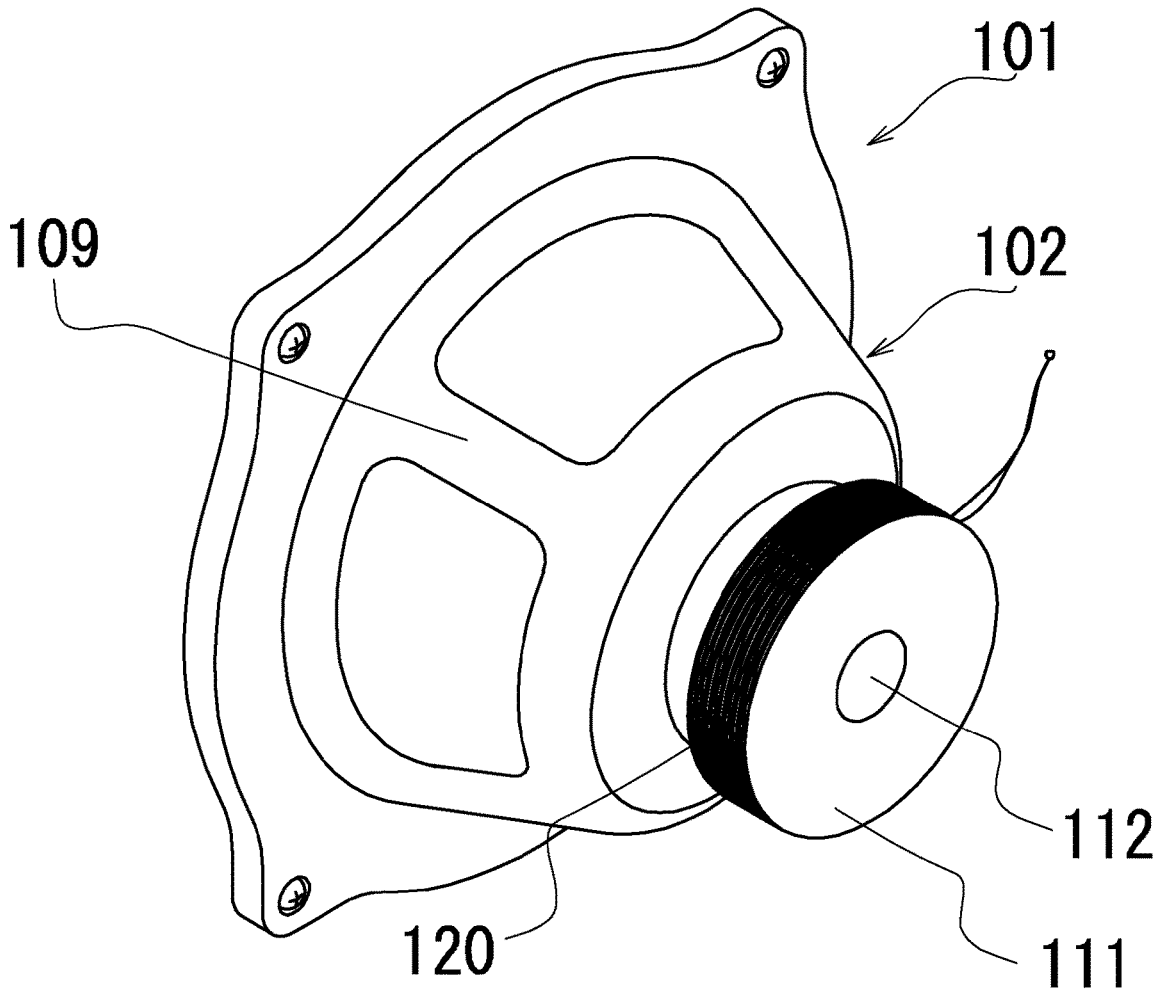

[Fig. 3]
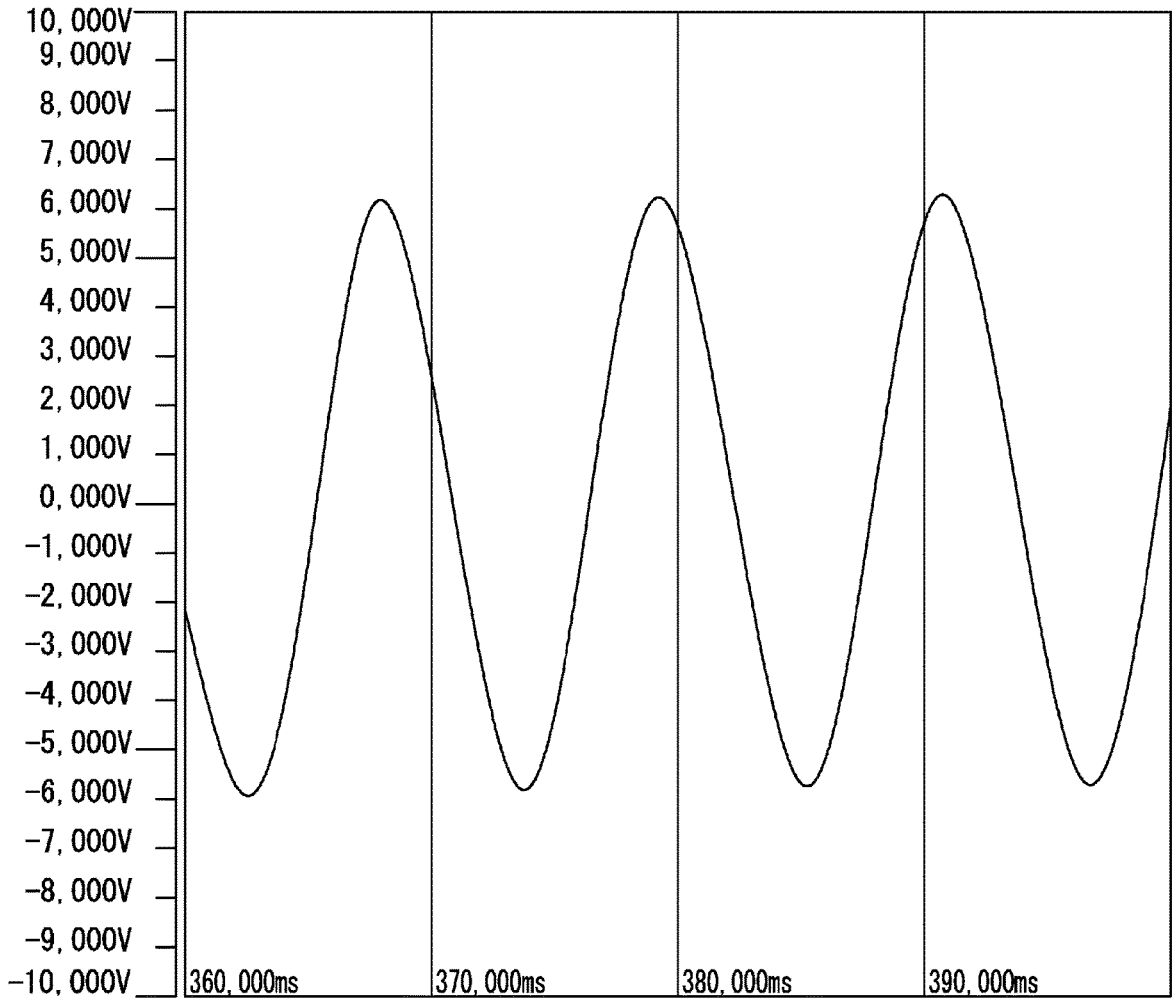

[Fig. 4]
(a)
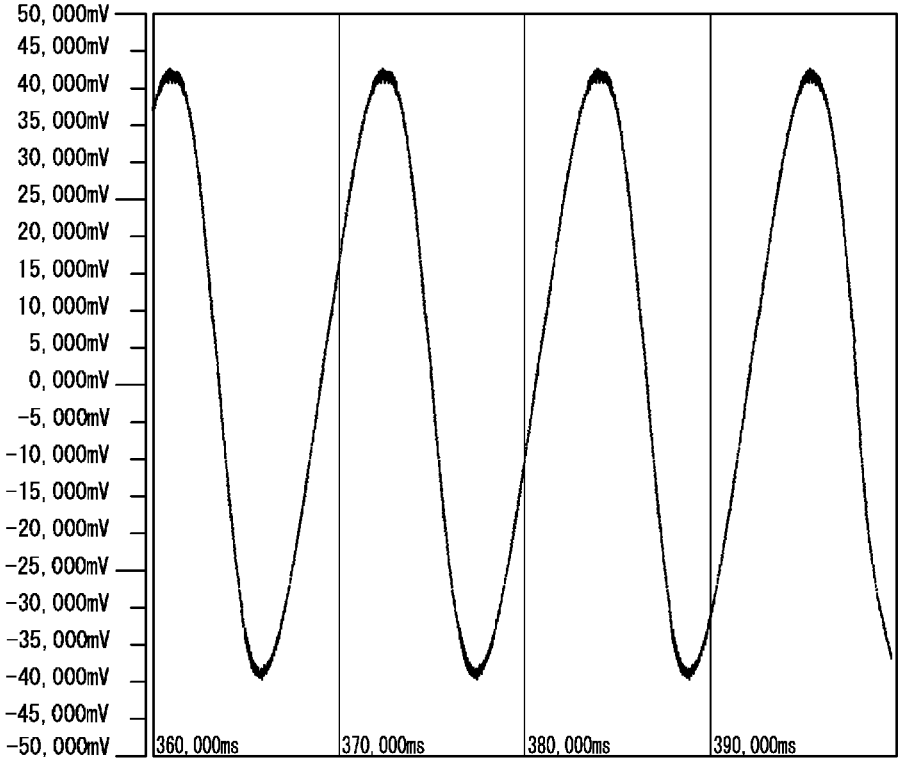
(b)
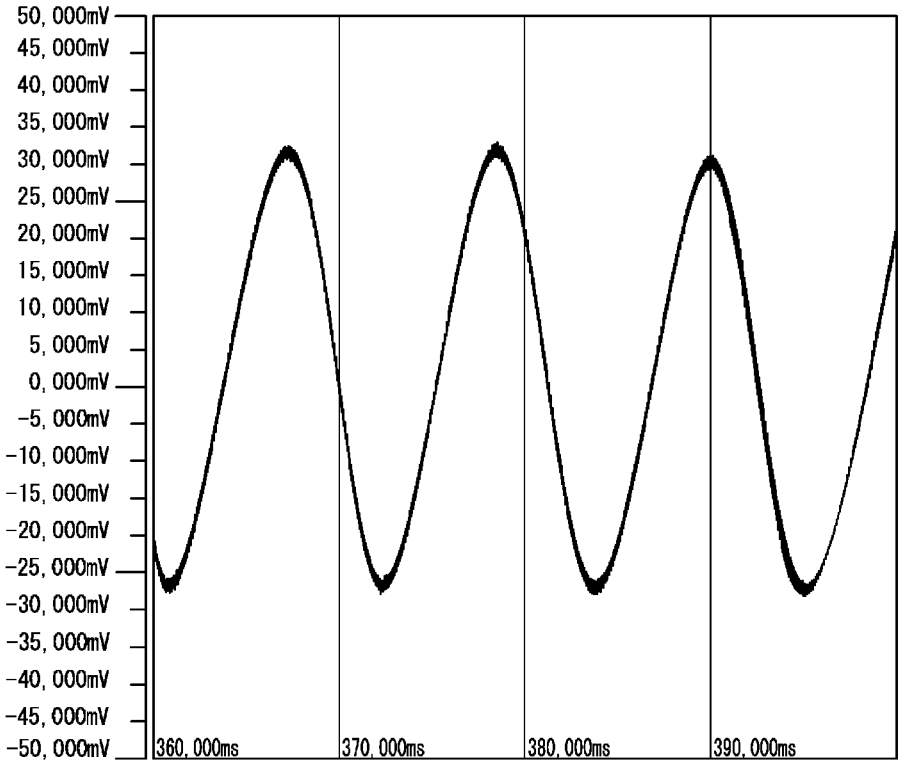

[Fig. 5]
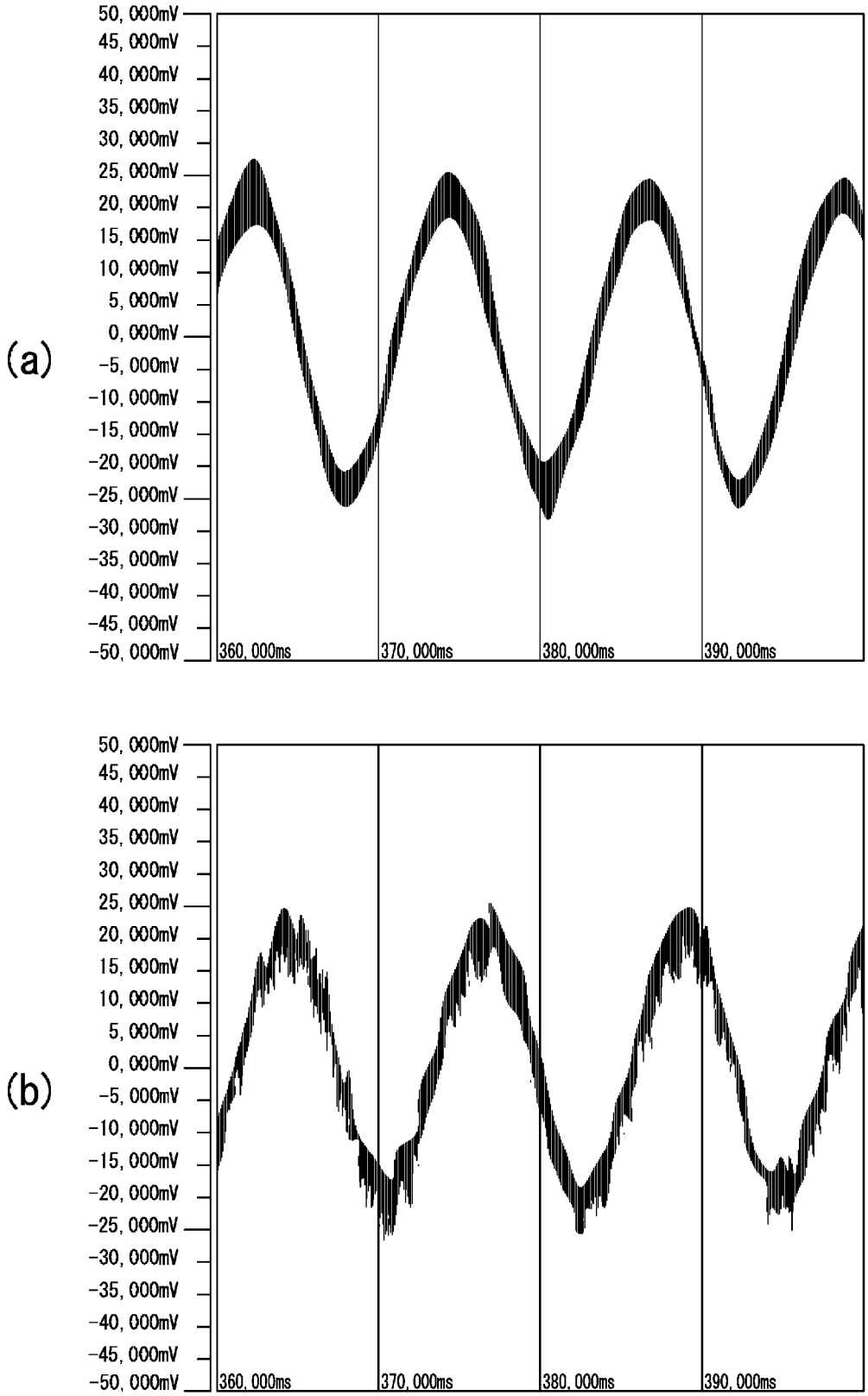

[Fig. 6]
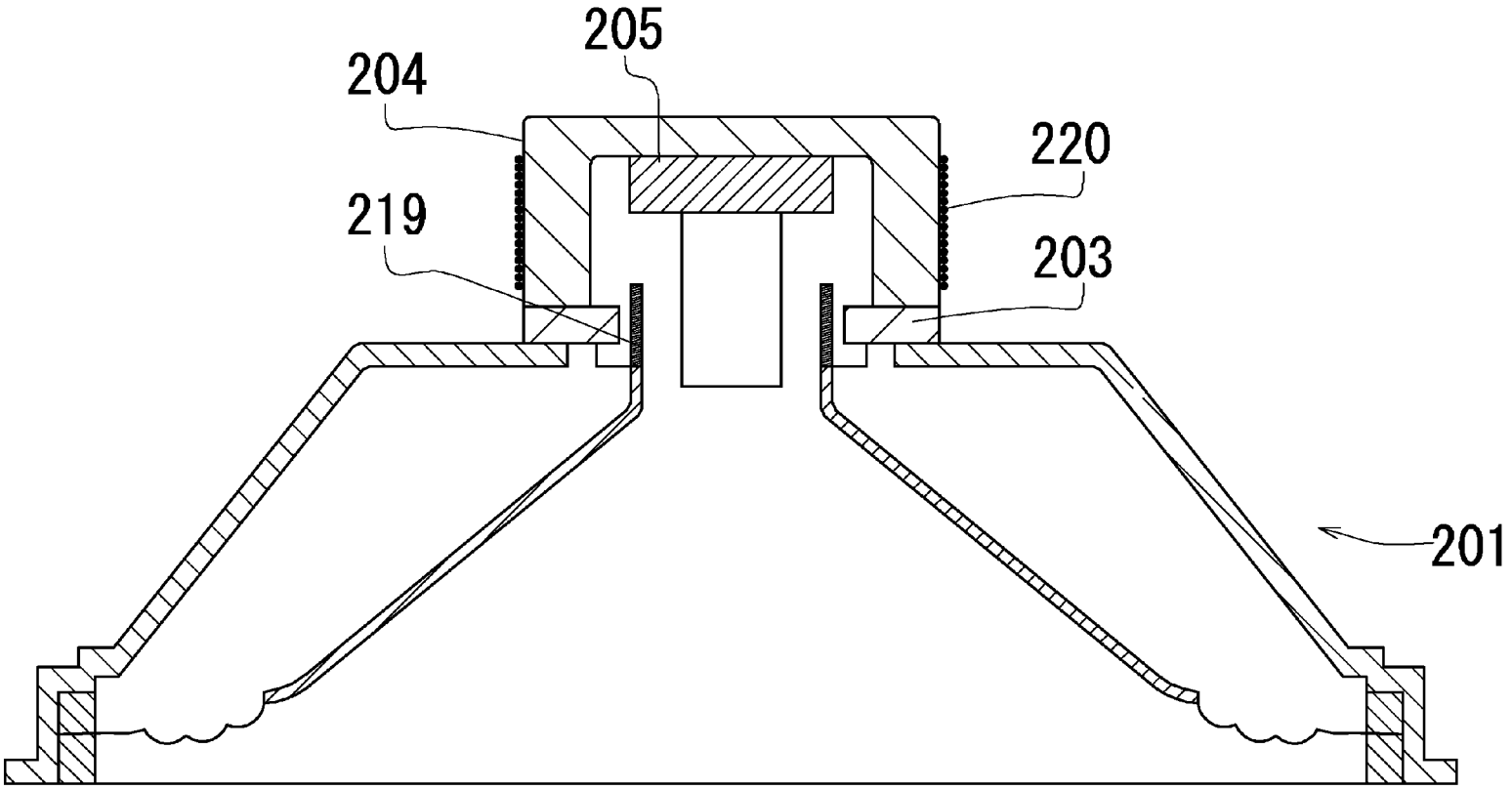

[Fig. 7]
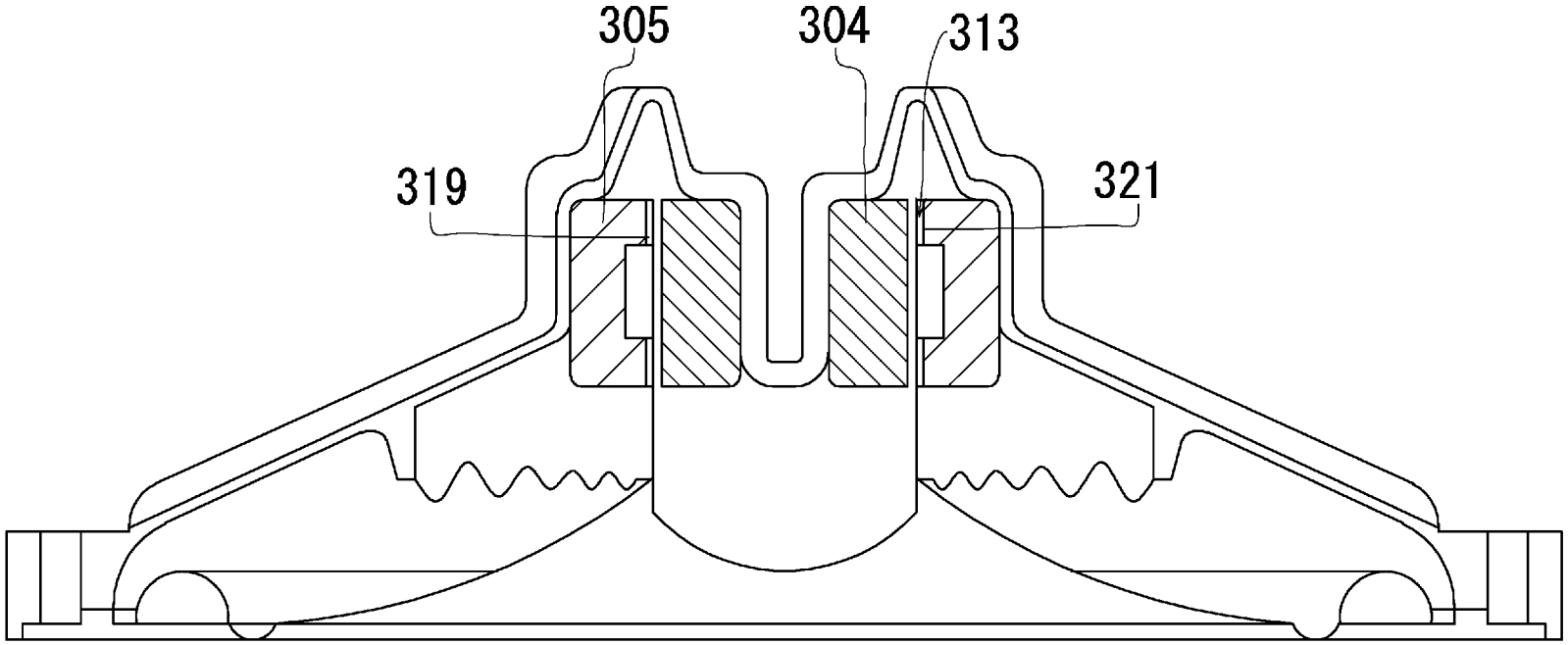

[Fig. 8]
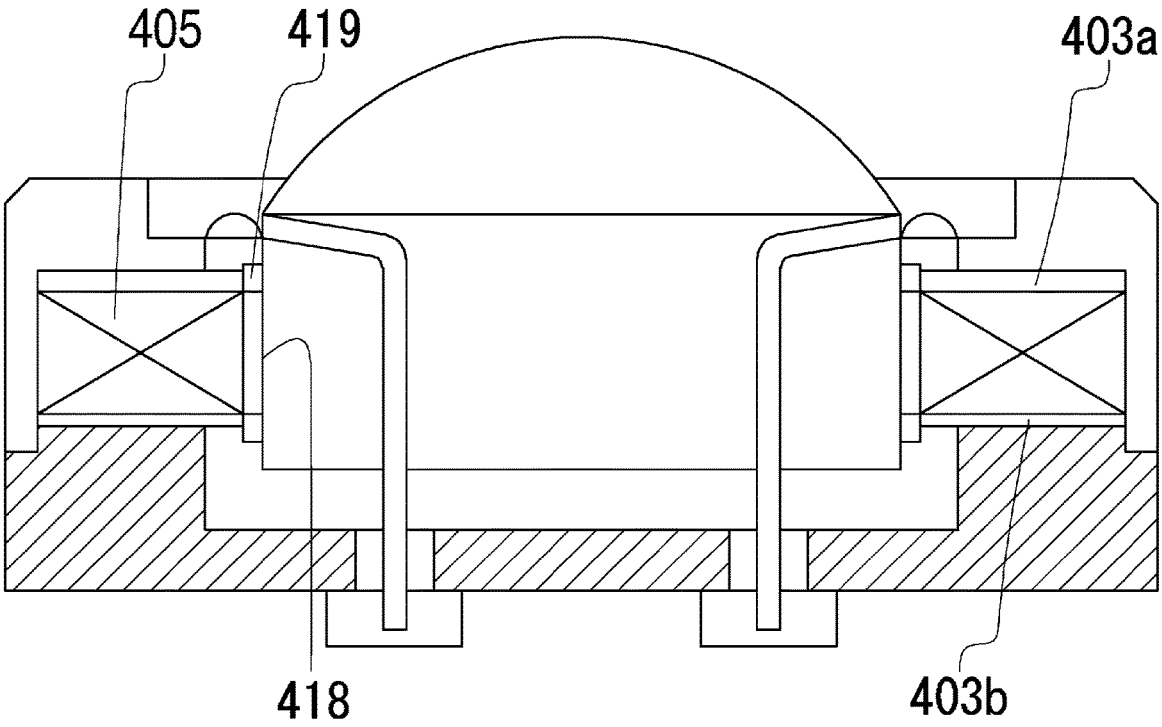

SPEAKER DEVICE, AND METHOD FOR IMPROVING SOUND QUALITY OF SPEAKER DEVICE

TECHNICAL FIELD

The present invention relates to a speaker device and a method for improving sound quality of a speaker device. In detail, the present invention relates to a speaker device and a method for improving sound quality of a speaker device, which can improve sound quality by suppressing generation of an eddy current that is generated during activation of a voice coil.

BACKGROUND ART

Speaker devices have become prevalent in home audio equipment and in-vehicle audio equipment, etc., and are widely adopted in personal computers and mobile terminals such as cell phones. In recent years, high-resolution sound sources in which sound information of a frequency band other than a zone of audibility, inaudible to the human ear,—are stored have attracted attention, and speaker devices adaptable to these high-resolution sound sources have also been actively developed.

Such a speaker device generally includes a magnetic circuit including a yoke, a magnet, a plate, and a center pole, etc., and a vibrating body including a voice coil, a diaphragm, and a frame, etc. When the speaker device operates, the voice coil vibrates according to a change in current flowing in the voice coil in a magnetic field made by the magnet, and further, the diaphragm connected to the voice coil vibrates to radiate sound waves to the outside.

For the magnetic circuit of the speaker device, a conductive material such as iron with high permeability is mainly used. Therefore, it is known that when a current is flowed in the voice coil, an AC magnetic field crosses the magnetic circuit by a magnetic field generated from the voice coil and generates an eddy current in a direction to obstruct a change in the magnetic circuit.

This eddy current causes a distortion of the current flowing in the voice coil, so that there is a risk that the eddy current blocks responsiveness of the voice coil and causes deterioration sound quality.

In order to reduce such an eddy current that causes deterioration in sound quality of a speaker device, for example, in Patent Literature 1, technology to reduce generation of an eddy current by making at least a portion of a yoke constituting a magnetic circuit, proximal to a magnet, of an iron powder bond has been proposed.

In detail, as shown in FIG. 7, a magnetic gap 313 is defined by an inner circumferential surface of a magnet 305 and an outer circumferential surface of a yoke 304, a voice coil 319 is inserted in this magnetic gap 313, and a portion of the yoke 304 facing the magnetic gap 313 is made of an iron Powder bond 321.

The iron powder bond 321 has higher volume resistivity and generates a higher electric resistance as compared with normal iron, so that an electric resistance at a peripheral portion of the voice coil 319 can be made larger relative to other portions. Therefore, an eddy current that is generated in the peripheral portion of the voice coil 319 can be minimized, responsiveness of the voice coil 319 to an electric signal is improved, and sound quality of the speaker device is improved.

Patent Literature 2 discloses a technology to suppress generation of an eddy current by not disposing a center pole that is considered to be a cause of generation of an eddy current, and is disposed on an inner circumferential side of a bobbin around which the voice coil is wound.

In detail, as shown in FIG. 8, ring-shaped plates 403*a* and 403*b* are disposed via a small gap on the outer circumferential side of the voice coil 419 wound around the bobbin 418 made of a non-magnetic material, and a magnet 405 that also has the same ring shape is disposed between these plates 403*a* and 403*b*. While an inner diameter of the magnet 405 is equal to inner diameters of the plates 403*a* and 403*b*, the outer diameter of the magnet 405 is larger than outer diameters of the plates 403*a* and 403*b*. Accordingly, it becomes easy for a magnetic flux that passes through both end faces in the axial direction of the magnet 405 to pass through the inner circumferential surfaces of the plates 403*a* and 403*b*. Therefore, a flux content that crosses the gap can be increased, so that even if a center pole is absent, a sufficient magnetic flux can be made to pass through the voice coil 419, and an eddy current that is generated by the presence of a center pole can be suppressed.

CITATION LIST

Patent Literatures

Patent Literature 1: Japanese Unexamined Patent Application Publication No. H9-51597

Patent Literature 2: Japanese Unexamined Patent Application Publication No. H11-122694

SUMMARY OF THE INVENTION

Technical Problem

However, in the technology described in Patent Literature 1, as the iron powder bond, iron powder is mixed with an epoxy resin, a curing agent, and an organic solvent as the remainder, compacted into a predetermined shape after the organic solvent is removed by a vacuum drying oven, and after heating and curing the epoxy resin, electro-painted and then processed into a yoke.

Therefore, a large number of manufacturing processes are necessary for manufacturing the iron powder bond, and its material cost is high, so that the feasibility of this technology is low. In addition, even if a portion of the center pole proximal to the voice coil is made of an iron powder bond, an eddy current that is generated when an AC magnetic field crosses the center pole cannot be completely eliminated, so that the effect on improvement in sound quality of a speaker device is limited.

On the other hand, in the technology described in Patent Literature 2, due to absence of the center pole, the magnetic field becomes relatively weak, and even if the center pole is not disposed, the newly installed ring plates made of a magnetic material become a source of generation of an eddy current, so that the sound quality may severely deteriorate. In addition, Patent Literature 2 discloses no objective measurement data relating to the effect of reducing an eddy current, and the effect is not obvious.

It is known that an eddy current generates a (+) potential or a (−) potential at each portion of a member constituting a magnetic circuit of a speaker device. That is, in order to eliminate an eddy current, (+) potentials or (−) potentials generated at the respective portions constituting the magnetic circuit need to be made equal to each other instantaneously. However, conventional technologies including Patent Literature 1 and Patent Literature 2 described above disclose no solution in terms of elimination of an eddy current by making (+) potentials or (−) potentials equal to each other.

The present invention was made in view of the above-described circumstances, and an object thereof is to provide a speaker device and a method for improving sound quality of a speaker device, which can improve sound quality by suppressing generation of an eddy current that is generated during activation of a voice coil.

Solution to Problem

In order to attain the object described above, a speaker device according to the present invention includes a frame that has a first substantially circular opening formed at a central portion thereof, and opens to expand toward one surface side, a substantially truncated cone-shaped diaphragm whose outer circumferential edge is attached to the frame, and which has a second substantially circular opening formed at a central portion thereof, and opens to expand toward one surface side, a substantially cylindrical voice coil bobbin whose one end side in an axial direction is attached to the diaphragm, a voice coil that is wound around an outer circumferential surface of the voice coil bobbin, a ring-shaped plate that has a third substantially circular opening formed at a central portion thereof, and is attached to a peripheral edge of the opening of the frame, a substantially discoid yoke, a substantially cylindrical center pole projecting to one surface side of a substantially central portion of the yoke, a magnet that is sandwiched by the plate and the yoke, has a fourth substantially circular opening which is formed at a central portion thereof and through which the center pole is inserted, and has magnetic pole faces on both end faces in an axial direction, and an insulation coated conductor wire that is wound around a part of an outer circumferential surface of the magnet, and has one end and the other end connected to each other.

Here, since the insulation coated conductor wire wound around a part of the outer circumferential surface of the magnet is provided, (+) potentials and (−) potentials mixed on the surface of the magnet can be confined in the insulation coated conductor wire.

By connecting one end and the other end of the insulation coated conductor wire, a current flows from (+) potentials to (−) potentials present in the insulation coated conductor wire and makes these potentials equal to each other, so that an eddy current can be eliminated instantaneously. Therefore, a distortion of a current due to an eddy current cart be corrected, responsiveness of the voice coil can be improved, and the sound quality of the speaker device can be improved.

When the insulation coated conductor wire is wound around a part of the outer circumferential surface of the yoke, (+) potentials and (−) potentials mixed on the surface of the yoke can be confined in the insulation coated conductor wire.

In addition, by connecting one end and the other end of the insulation coated conductor wire, a current flows from the (+) potentials to (−) potentials present inside the insulation coated conductor wire and makes the potentials equal to each other, so that an eddy current can be eliminated instantaneously. Therefore, distortion of a current due to an eddy current can be corrected, responsiveness of the voice coil can be improved, and the sound quality of the speaker device can be improved.

When the insulation coated conductor wire is wound around a part of an outer circumferential surface in an axial direction of the center pole, (+) potentials and (−) potentials mixed on the center pole can be confined in the insulation coated conductor wire.

In addition, by connecting one end and the other end of the insulation coated conductor wire, a current flows from the (+) potentials to the (−) potentials present inside the insulation coated conductor wire and makes the potentials equal to each other, so that an eddy current can be eliminated instantaneously. Therefore, distortion of a current due to an eddy current can be corrected, responsiveness of the voice coil can be improved, and the sound quality of the speaker device can be improved.

When the insulation coated conductor wire is wound around a part of an outer circumferential surface of the plate, (+) potentials and (−) potentials mixed on the plate can be confined in the insulation coated conductor wire.

In addition, by connecting one end and the other end of the insulation coated conductor wire, a current flows from the (+) potentials to (−) potentials present inside the insulation coated conductor wire and makes the potentials equal to each other, so that an eddy current can be eliminated instantaneously. Therefore, distortion of a current due to an eddy current can be corrected, responsiveness of the voice coil can be improved, and the sound quality of the speaker device can be improved.

In order to attain the object described above, a speaker device according to the present invention includes vibrating body components constituting a vibrating body, consisting of at least a voice coil, a diaphragm, and a frame, magnetic circuit components constituting a magnetic circuit, consisting of at least a yoke, a magnet, a center pole, and a plate, and an insulation coated conductor wire that is wound around an cuter circumferential surface of at least one component of the magnetic circuit components, and has one end and the other end connected to each other.

Here, since an insulation coated conductor wire wound around an outer circumferential surface of at least one component of magnetic circuit components consisting of a yoke, a magnet, a center pole, and a plate, is provided, (+) potentials and (−) potentials mixed on the surface of any component of the yoke, the magnet, the center pole, and the plate can be confined in the insulation coated conductor wire.

In addition, by connecting one end and the other end of the insulation coated conductor wire, a current flows from the (+) potentials to (−) potentials present inside the insulation coated conductor wire wound around any component of the magnetic circuit components consisting of the yoke, the magnet, the center pole, and the plate, and makes the potentials equal to each other, so that an eddy current can be eliminated instantaneously. Therefore, distortion of a current due to an eddy current can be corrected, responsiveness of the voice coil can be improved, and the sound quality of the speaker device can be improved.

In order to attain the object described above, a method for improving sound quality of a speaker device according to the present invention includes a step of winding an insulation coated conductor wire around an outer circumferential surface of at least one component of magnetic circuit components constituting a magnetic circuit, consisting of at least a yoke, a magnet, a center pole, and a plate, and a step of connecting one end and the other end of the insulation coated conductor wire.

Since the method includes the step of winding an insulation coated conductor wire around an outer circumferential surface of at least one component of magnetic circuit components constituting a magnetic circuit, consisting of a yoke, a magnet, a center pole, and a plate, (+) potentials and (−) potentials mixed on the surface of any component of the yoke, the magnet, and the center pole can be confined in the insulation coated conductor wire.

In addition, since the method includes the step of connecting one end and the other end of the insulation coated conductor wire, a current flows from the (+) potentials to (−) potentials present inside the insulation coated conductor wire wound around any component of magnetic circuit components consisting of the yoke, the magnet, the center pole, and the plate, and makes the potentials equal to each other, so that an eddy current can be eliminated instantaneously. Therefore, distortion of a current due to an eddy current can be corrected, responsiveness of the voice coil can be improved, and the sound quality of the speaker device can be improved.

Effects of the Invention

The speaker device and the method for improving sound quality of a speaker device according to the present invention can improve the sound quality by suppressing generation of an eddy current that is generated during activation of the voice coil.

BRIEF DESCRIPTION OF THE DRAWINGS

FIG. 1 is a sectional view of a speaker device according to an embodiment of the present invention.

FIG. 2 is an external perspective view of the speaker device according to the embodiment of the present invention.

FIG. 3 is a graph showing an electric signal (voltage) that was input at the time of voltage measurement.

FIG. 4 are graphs showing measurement results of an electric signal when an insulation coated conductor wire was wound around an outer circumference of a magnet.

FIG. 5 are graphs showing measurement results of an electric signal when an insulation coated conductor wire was wound around an outer circumference of a magnet and a yoke.

FIG. 6 is a sectional view of a speaker device according to a second embodiment of the present invention.

FIG. 7 is a view showing a conventional technology.

FIG. 8 is a view showing a conventional technology.

BEST MODE FOR CARRYING OUT THE INVENTION

Hereinafter, embodiments of the present invention relating to a speaker device and a method for improving sound quality of a speaker device are described with reference to the drawings, for understanding of the present invention.

First, an overall configuration of a speaker device 101 according to an embodiment to which the present invention is applied is described with reference to FIG. 1. The speaker device 101 outputs audio data from a reproducing device not shown in the drawings by sound production, and is an external magnetic dynamic speaker mainly consisting of a frame 102, a plate 103, a yoke 104, a magnet 105, a diaphragm 106 and a voice coil bobbin 117.

The frame 102 has a first circular opening 107 formed at a substantially central portion of a bottom surface, and a cylindrical frame bottom portion 108 that opens toward one surface side. On an outer circumferential edge of this frame bottom portion 108, bridging portions 109 are radially provided so as to open to expand relative to each other at a tip end side. To the frame 102, an input terminal 110 into which audio data as an electric signal is input is attached.

The frame 102 is integrally provided with a plate 103 and a yoke 104 constituting a magnetic circuit. The plate 103 is formed into a ring shape from, for example, a magnetic material, and attached to a bottom surface of the frame 102 by a known attaching means such as an adhesive agent.

The yoke 104 is made of, for example, a magnetic material like the plate 103, and a substantially discoid yoke bottom portion 111, and a substantially cylindrical center pole 112 on one surface side at a substantially central portion of the yoke bottom portion 111, are integrally configured. A magnetic gap 113 as a predetermined gap is formed between an outer circumference of the center pole 112 and an inner circumference of the plate 103.

Here, the center pole 112 does not necessarily have to be configured integrally with the yoke bottom portion 111. For example, it is allowed that the yoke bottom portion 111 and the center pole 112 are configured as separate bodies, and the center pole may be attached to the substantially central portion of the yoke bottom portion 111 by a known attaching means such as an adhesive agent.

The magnet 105 is a substantially ring-shaped ferrite magnet having magnetic poles of an N pole and an S pole formed on both end faces in an axial direction. This magnet 105 is disposed between the plate 103 and the yoke bottom portion 111, and is attached by a known attaching means such as an adhesive agent in a state where it penetrates through the center pole 112. Accordingly, an outer circumferential surface of the center pole 112 and an inner circumferential surface of the plate 103 face each other with different magnetic poles, and constitute a magnetic circuit together with the magnet 105.

Here, the magnet 105 does not necessarily have to be a ferrite magnet. For example, in place of the ferrite magnet, an alnico magnet, a neodymium magnet, or the like can be adopted.

The diaphragm 106 has a cone-shaped vibrating portion 114 that is made of paper and opens to expand toward one surface side. On an outer peripheral edge of this vibrating portion 114, an edge portion 115 is provided, and an outer circumferential edge of this edge portion 115 is attached to the frame 102 via an attaching member 116.

Here, the diaphragm 106 does not necessarily have to be cone-shaped. For example, depending on the application, various shapes such as a dome shape and a planar shape, etc., can be adopted.

The diaphragm 106 does not necessarily have to be made of paper. For example, depending on the application, various materials such as a metal and a resin, etc., can be adopted.

The diaphragm 106 is integrally provided with a voice coil bobbin 117. This voice coil bobbin 117 includes a substantially cylindrical bobbin 118, and a voice coil 119 that is formed by coating an insulating layer on the surface of a copper wire, and is wound around an outer circumferential surface or one end side in an axial direction of the bobbin 118.

In the speaker device configured as described above, when a current is input into the voice coil 119, based on Fleming's left hand rule, a driving force (Lorentz force) is applied to the voice coil 119 inside the magnetic gap 113 and vibrates the diaphragm 116 in the axial direction of the speaker device 101, and a sound wave is radiated. In the plate 103, the magnet 105, the yoke 104, and the center pole 112 constituting a magnetic circuit, (+) potentials or (−) potentials are always mixed. Due to this vibration of the voice coil 119, magnetic variation occurs, and (−) potentials or (−) potentials present on the magnetic circuit flow as an eddy current. At this time, based on Fleming's rule, a force acts in a direction blocking a vibration direction of the diaphragm 116, that is, in a direction perpendicular to the axial direction of the speaker device 101.

Therefore, in the present embodiment, an insulation coated conductor wire 120 that is a magnet wire coated with an insulating material is wound around an outer circumference in the axial direction of the magnet 105 constituting the magnetic circuit. This insulation coated conductor wire 120 has a diameter of, for example, 0.8 cm, and the number N of windings is set to 70.

Here, the insulation coated conductor wire 120 does not necessarily have to be wound around the outer circumference in the axial direction of the magnet 105. The insulation coated conductor wire may be wound around any one of the components constituting the magnetic circuit, for example, any one of the center pole 112, the yoke 104, the plate 103, or all of these components. However, on the magnet 105 having strongest magnetism, more (+) potentials and (−) potentials are mixed, so that by winding the insulation coated conductor wire 120 around the outer circumference of the magnet 105, more (+) potentials and (−) potentials can be confined in the insulation coated conductor wire 120, and the effect of eliminating an eddy current is improved.

The number of windings of the insulation coated conductor wire 120 does not necessarily have to be 70. For example, the number of windings can be changed as appropriate according to a component around which the insulation coated conductor wire is wound. However, as the number N of windings increases, the surface area of the insulation coated conductor wire 120 becomes larger, and more (+) potentials and (−) potentials can be confined in the insulation coated conductor wire, so that the effect of eliminating an eddy current is also improved.

At one end and the other end of the insulation coated conductor wire 120, the conductor wire is not coated with the insulating material and is exposed, and the one end and the other end are electrically connected by, for example, soldering, etc. Thus, by connecting one end and the other end of the insulation coated conductor wire 120 to each other, (+) potentials and (−) potentials present inside the insulation coated conductor wire 120 become equal to each other instantaneously, and an eddy current can be eliminated.

Here, in order to confirm the effect of the present invention, current values when one end and the other end of the insulation coated conductor wire 120 were connected and when the one end and the other end were disconnected, were measured with an oscilloscope in the embodiment described above. A speaker device and test conditions, etc., used for the measurement are as follows.

(Specifications of Speaker Device)
Manufacturer's name: SIEMENS
Model: C98233-A9803-A1
For full bandwidth: 25 cm coaxial unit
For low bandwidth: 25 cm cone-shaped
For high bandwidth: 9 cm cone-shaped
Impedance: 15Ω
Frequency characteristics: 60 Hz to 16 kHz
Efficiency: 98 dB/1 W
(Measurement Location)
Mechanics and Electronics Research Institute, Fukuoka Industrial Technology Center
3-6-1, Norimatsu, Yahata Nishi-Ku, Kitakyushu city, Fukuoka Pref.
(Test Conditions)
Number (N) of windings of insulation coated conductor wire 120: 70
Winding position of insulation coated conductor wire 120: Outer circumference of magnet 105

For measurement of a current value, an insulation coated wire for measurement not shown in the drawings was wound around the outer circumference of the insulation coated conductor wire 120, and one end and the other end of the insulation coated wire for measurement were connected to an input terminal of the oscilloscope, and then, a current flowing in the insulation coated conductor wire 120 was measured.

A current waveform flowing in a measuring target portion (the outer circumference of the magnet 105) in a case where one end and the other end of the insulation coated conductor wire 120 were disconnected from each other when an AC voltage for measurement having the waveform shown in FIG. 3 was input into the voice coil 119 under the test conditions described above, is shown in FIG. 4(*a*). In addition, a current waveform flowing in the measuring target portion (the outer circumference of the magnet 105) when one end and the other end of the insulation coated conductor wire 120 were connected to each other, is shown in FIG. 4(*b*). FIG. 4(*a*) and FIG. 4(*b*) show results of voltage conversion of current waveforms flowing in the measuring target portion along with application of the voltage for measurement, and the sweep time is 2 ms/div.

Here, a sum of (+) potentials and (−) potentials present in the insulation coated conductor wire 120 is a total voltage, however, as shown in FIG. 4(*a*), in the state where one end and the other end of the insulation coated conductor wire 120 are connected to each other, (+) potentials and (−) potentials present in the insulation coated conductor wire 120 are mixed, so that in response to a fluctuation in magnetic field along with driving of the voice coil 119, an eddy current is generated, and a measured maximum current becomes large.

FIG. 5 show measurement results of a current value in a measurement target portion by the oscilloscope when the AC voltage for measurement shown in FIG. 3 was input into the voice coil 119 in the case where the insulation coated conductor wire 120 was wound around each of the outer circumference of the magnet 105 and the outer circumference of the yoke 104.

FIG. 5(*a*) shows a current waveform flowing in the measuring target portion when one end of the insulation coated conductor wire 120 wound around the magnet 105 and the other end of the insulation coated conductor wire 120 wound around the yoke 104 were connected to each other, and the other end of the insulation coated conductor wire 120 wound around the magnet 105 and one end of the insulation coated conductor wire 120 wound around the yoke 104 were connected to each other.

FIG. 5(*b*) shows a current waveform flowing in the measuring target portion when one end and the other end of the insulation coated conductor wire 120 wound around the magnet 105 were connected, and one end and the other end of the insulation coated conductor wire 120 wound around the yoke 104 were connected. The measurement results are those of voltage conversion of current waveforms flowing in the measuring target portion along with application of the voltage for measurement as in the case of FIG. 4, and the sweep time is 200 μs/div.

As shown in FIG. 5, by winding the insulation coated conductor wire 120 around the yoke 104 as well as the outer circumference of the magnet 105, as compared with FIG.

4(*a*), the measured maximum current becomes smaller, so that it can be confirmed that the effect of eliminating an eddy current is remarkably shown.

As described above, by winding the insulation coated conductor wire 120 around the outer circumference of the magnet 105 that is one of the components of the magnetic circuit, (+) potentials and (−) potentials on the surface of the magnet 105 can be confined in the insulation coated conductor wire 120, and by connecting one end and the other end of the wound insulation coated conductor wire 120, (+) potentials and (−) potentials present inside the insulation coated conductor wire 120 can be made equal to each other instantaneously, and generation of an eddy current can be suppressed.

Next, a second embodiment of the present invention will be described with reference to FIG. 6. Detailed description of a portion common in the first embodiment described above will be omitted.

As shown in FIG. 6, in the second embodiment, the present invention is applied to an inner magnetic speaker device 201. That is, the speaker device 201 in the second embodiment includes a magnet 205 attached to the vicinity of the substantially center of a bottom portion of the yoke 204, and a center pole 212 installed on a surface opposite to the attaching surface of the magnet 205 to be attached to the bottom portion of the yoke 204.

On an end face portion of the yoke 204, a plate 203 is installed with a certain gap to the center pole 212. The yoke 204, center pole 212, and plate 203 are made of a magnetic material, and constitute a magnetic circuit together with the magnet 205.

Even in the inner magnetic speaker device 201 configured as described above, for example, as shown in FIG. 6, by winding an insulation coated conductor wire 220 around a part of an outer circumference of the yoke 204 constituting the magnetic circuit, (+) potentials and (−) potentials mixed on the surface of the yoke 204 can be confined in the insulation coated conductor wire 220. In addition, by connecting one end and the other end of the insulation coated conductor wire 220, a current flows from (+) potentials to (−) potentials present in the insulation coated conductor wire 220 and makes the potentials equal to each other, so that an eddy current can be eliminated instantaneously, distortion of a current due to an eddy current can be corrected, responsiveness of the voice coil 219 can be improved, and sound quality of the speaker device 201 can be improved.

Here, the insulation coated conductor wire 220 does not necessarily have to be wound around only the outer circumference of the yoke 204. As in the case of the first embodiment, the insulation coated conductor wire 220 may be wound around any or all of, for example, the magnet 205, the center pole 212, and the plate 203 as long as the component is a component constituting a magnetic circuit.

As described above, a speaker device and a method for improving sound quality of a speaker device to which the present invention is applied can improve sound quality by suppressing generation of an eddy current that is generated during activation of a voice coil.

REFERENCE SIGNS LIST

101, 201 Speaker device
102 Frame
103, 203, 403*a*, 403*b* Plate
104, 204, 304 Yoke
105, 205, 305, 405 Magnet
106 Diaphragm
107 Opening
108 Frame bottom portion
109 Bridging portion
110 Input terminal
111 Yoke bottom portion
112, 212 Center pole
113, 313 Magnetic gap
114 Vibrating portion
115 Edge portion
116 Attaching member
117 Voice coil bobbin
118, 418 Bobbin
119, 219, 319, 419 Voice coil
120, 220 Insulation coated conductor wire
321 Iron powder bond

The invention claimed is:

1. A speaker device comprising:

a frame that has a first substantially circular opening formed at a central portion thereof, and opens to expand toward one surface side;

a substantially truncated cone-shaped diaphragm having an outer circumferential edge attached to the frame, wherein the diaphragm has a second substantially circular opening formed at a central portion thereof and the diaphragm opens to expand toward one surface side;

a substantially cylindrical voice coil bobbin having one end side attached to the diaphragm in an axial direction;

a voice coil that is wound around an outer circumferential surface of the voice coil bobbin;

a ring-shaped plate that has a third substantially circular opening formed at a central portion thereof, and wherein the plate is attached to a peripheral edge of the opening of the frame;

a substantially discoid yoke;

a substantially cylindrical center pole projecting towards one surface side of a substantially central portion of a yoke bottom portion of the yoke;

a magnet that is disposed between the plate and the yoke and that has a fourth substantially circular opening formed at a central portion thereof, and wherein the center pole is inserted into the fourth opening of the magnet and the magnet has magnetic pole-faces on both end faces of the magnet in an axial direction; and an insulation coated conductor wire that is wound around each of outer circumferential surfaces of the yoke and the magnet, has a coated surface on a side opposite to the one side surface of the yoke bottom portion, and has one exposed end and the other exposed end electrically connected to each other, wherein the insulation coated conductor wire is not connected with the voice coil via wiring.

2. The speaker device according to claim 1, wherein the insulation coated conductor wire is wound around a part of an outer circumferential surface of the center pole in an axial direction.

3. The speaker device according to claim 1, wherein the insulation coated conductor wire is wound around a part of an outer circumferential surface of the plate.

4. A method of improving sound quality of a speaker device having magnetic circuit components constructed as a magnetic circuit which comprises a ring-shaped plate, a substantially discoid yoke, a central pole projecting towards one surface side of a substantially central portion of a yoke bottom portion of the yoke and a magnet disposed between the plate and the yoke, the method comprising the steps of:

winding an insulation coated conductor wire around each of outer circumferential surfaces of the yoke and the magnet;

coating a surface of the insulation coated conductor wire on a side opposite to the one side surface of the yoke bottom portion;

confining (+) potentials and (−) potentials, induced from an AC voltage input into a voice coil, that are mixed on surfaces of the yoke and the magnet to the insulation coated conductor wire; and making (+) potentials and (−) potentials confined in the insulation coated conductor wire equal to each other by electrically connecting one exposed end and the other exposed end of the insulation coated conductor wire, wherein the insulation coated conductor wire is not connected to the voice coil via wiring.

5. The method according to claim 4, the insulation coated conductor wire is wound around a part of an outer circumferential surface of the central pole in an axial direction.

6. The method according to claim 4, the insulation coated conductor wire is wound around a part of an outer circumferential surface of the plate.

* * * * *